US005960236A

United States Patent [19]

Zaman et al.

[11] Patent Number: 5,960,236

[45] Date of Patent: Sep. 28, 1999

[54] RECYCLED SILENCER

[75] Inventors: Kamran U. Zaman; George A. Schutt, both of Pittsford, N.Y.

[73] Assignee: Xerox Corporation, Stamford, Conn.

[21] Appl. No.: 09/143,049

[22] Filed: Aug. 28, 1998

[51] Int. Cl.[6] ..... G03G 15/00

[52] U.S. Cl. ..... 399/91; 399/109; 399/159

[58] Field of Search ..... 399/91, 109, 159; 181/196, 200, 201, 202, 207, 208

[56] References Cited

U.S. PATENT DOCUMENTS

| | | | |
|---|---|---|---|
| 4,601,963 | 7/1986 | Takahashi et al. | 430/69 |
| 5,430,526 | 7/1995 | Ohkubo et al. | 399/159 |
| 5,669,045 | 9/1997 | Swain | 399/159 |
| 5,722,016 | 2/1998 | Godlove et al. | 399/159 |

FOREIGN PATENT DOCUMENTS

| | | |
|---|---|---|
| 63-60480 | 3/1988 | Japan . |
| 2-118684 | 5/1990 | Japan . |
| 5-35166 | 2/1993 | Japan . |
| 5-35167 | 2/1993 | Japan . |
| 5-281733 | 10/1993 | Japan . |
| 63-060481 | 5/1998 | Japan . |
| 63-271388 | 11/1998 | Japan . |

*Primary Examiner*—William Royer
*Assistant Examiner*—William A. Noe

[57] ABSTRACT

A silencer including a hollow tube having, in the free state a predetermined inside diameter, the tube including a tube wall having a substantially uniform thickness, an interior surface, a hard exterior surface at least one groove extending axially of the tube, the groove having a depth that is less than the thickness of the tube wall and a slot in the wall extending axially of the tube, and at least one partially compressed high density polymeric open cell foam plug in the interior of the hollow tube, the plug having in the uncompressed state a substantially circular cross section in at least one plane, the circular cross section of the plug having an outside diameter sufficient to increase the inside diameter of the hollow tube to a diameter at least about 5 percent greater than the predetermined inside diameter of the hollow tube in the free state. The hollow tube portion of the silencer may be recovered from a used hollow photoreceptor drum, combined with a high density polymeric open cell foam plug and installed in a fresh hollow photoreceptor drum.

21 Claims, 3 Drawing Sheets

RECYCLED SILENCER

BACKGROUND OF THE INVENTION

This invention relates in general to an electrostatographic imaging silencer and more specifically to a recycled silencer and a method of recovering and using the silencer.

Electrostatographic imaging members are well known in the art. The imaging members may be in the form of various configurations such as a flexible web type belt or cylindrical drum. The drums comprise a hollow cylindrical substrate and at least one electrostatographic coating. These drums are usually supported by a hub held in place at the end of each drum. The hub usually includes a flange extending into the interior of the drum. This flange is usually retained in place by an adhesive. An axle shaft through a hole in the center of each hub supports the hub and drum assembly. Electrostatographic imaging members may be electrophotographic members or electrographic. It is well known that electrophotographic members comprise at least one photosensitive imaging layer and are imaged with the aid of activating radiation in image configuration whereas electrographic imaging members comprise at least one dielectric layer upon which an electrostatic latent image is formed directly on the imaging surface by shaped electrodes, ion streams, styli and the like. A typical electrostatographic imaging process cycle involves forming an electrostatic latent image on the imaging surface, developing the electrostatic latent image to form a toner image, transferring the toner image to a receiving member and cleaning the imaging surface. Cleaning of the imaging surface of electrostatographic imaging members is often accomplished with a doctor type resilient cleaning blade that is rubbed against the imaging surface of the imaging members.

When electrostatographic imaging members are cleaned by doctor type cleaning blades rubbing against the imaging surface to remove residual toner particles remaining on the imaging surface after toner image transfer to a receiving member, a high pitched ringing, squealing, squeaking, or howling sound can be created which is so intense that it is intolerable for machine operators. This is especially noted in drum type imaging members comprising a hollow cylindrical substrate. The sound apparently is caused by a "stick-slip" cycling phenomenon during which the cleaning blade initially "sticks" to the imaging surface and is carried in a downstream direction by the moving imaging surface to a point where resilience of the imaging blade forces the tucked blade to slip and slide back upstream where it again sticks to the photoreceptor and is carried downstream with the imaging surface until blade resilience again causes the blade to flip back to its original position. The upstream flipping motion kicks residual toner particles forward. The stick-slip phenomenon is somewhat analogous to the use of a push broom for cleaning floors where the push broom is most effective for cleaning when it is pushed a short distance and then tapped on the floor with the cycle being repeated again and again. This stick-slip phenomenon is important for effective removal of residual untransferred toner particles from an imaging surface and for prevention of undesirable toner film or toner comets from forming on the imaging surface during cleaning.

An adhesive relationship between the cleaning blade and the imaging member surface appears to contribute to the creation of the ringing, squealing, squeaking, or howling sound. More specifically, the stick-slip effect occurs where there is a strong adhesive interaction between the cleaning blade and the imaging surface. The ringing, squealing, squeaking, or howling sound appears to be caused by resonant vibration of the drum induced by the stick-slip phenomenon. Other factors contributing to creation of the ringing, squealing, squeaking, or howling sound may include factors such as the construction of the imaging member, the blade contacting the imaging member, the type of blade holder construction, and the like. For example, a flimsy blade holder can contribute to the howling effect. Moreover, a thinner, shorter, stubbier cleaning blade tends to contribute the howling effect. Thin imaging member drums can also lead to the howling effect. The stick-slip phenomenon also depends on the lubricating effect of toner and/or carrier materials utilized. Moreover, ambient temperatures can contribute to the creation of howling. It appears that resonance is initiated at the point of contact between the cleaning blade and the imaging member. The creation of the squealing or howling sound might be analogous to rubbing a fingertip around the edge of a wine glass. The squealing or howling noise phenomenon is especially noticeable for cylindrical photoreceptors having a hollow metal or plastic drum shaped substrate. Generally, where the imaging member is the cause of a howling sound, it will emit a ringing sound when tapped.

These sounds cannot be tolerated in a office environment. To overcome this drawback, various devices have been developed which can be inserted inside the hollow drum to dampen the drum and diminish or eliminate all irritating sounds emitted during imaging operation. Some of these devices include, for example, porous members which are compressed when inserted inside a hollow photoreceptor drum to perform a sound deadening function while pressing against the inner surface of the drum. Examples of this type of sound dampener is described, for example, in U.S. Pat. No. 5,722,016, Japanese Patent Publication 63060481, published Mar. 16, 1998 and Japanese Patent Publication 63271388, published Nov. 9, 1998.

Other devices for insertion into the interior of a hollow photoreceptor drum include a weighting material coated with an elastic layer to allow press-fitting of the coating weighting material inside an imaging drum. This type of insert device is difficult to insert into a drum and is also difficult to remove from the drum because of the high coefficient of friction between the elastic coating and the interior surface of the drum and the desire to avoid creating any debris from abrasion of the elastic material. See for example, U.S. Pat. No. 5,430,526 and Japanese Patent Publication 5-35166, published Feb. 12, 1993.

Still another device for preventing undesirable sounds in a drum photoreceptor include a control member having a "C" cross-section. This type of device is described, for example, in Japanese Patent Publication 02118684, published May 2, 1990. This device it is difficult to compress and slide into a hollow drum unless the control member is very thin. A very thin control member may not have sufficient mass to dampen any squeaking sound. However, thicker silencer members having a "C" shaped cross-section may be utilized if modified to form a hinge of thinner material extending axially along the length of the "C" shaped member. The hinge of thinner material is preferably located opposite the gap of the "C" shaped member. This hinge allows a relatively thick silencer to be more easily squeezed so that the exposed ends at the longitudinal gap come together to form a silencer having a smaller cross-section thereby allowing the silencer to be inserted into the hollow drum. This arrangement also facilitates removal of the silencer from the drum for recycling. Unfortunately, it has been found that where a silencer having a "C" shaped cross-section and a hinge is utilized in a photoreceptor drum that has been cycled many thousands of cycles, the cross-sectional area of the silencer becomes smaller due to the silencer taking a "set" while it's in the compressed mode within the interior of the drum. Thus, upon removal of the silencer for recycling and use in a fresh drum, the silencer loses its effectiveness for dampening sounds due to insufficient pressure contact between the silencer and the interior of the drum. Both the outside diameter and inside diameter of the "C" shaped silencer become smaller with use. Such reduction is believed to be the result of plastic deformation while under partial compression in the interior of a photoreceptor hollow photoreceptor drum. Thus, the used silencer is unsuitable for reliable recycling in fresh photoreceptor drums.

INFORMATION DISCLOSURE STATEMENT

Japanese Patent Publication No. 02118684 Abstract to Murakami Kohei, published May 2, 1990—PURPOSE: to prevent resonance between creaking sound produced when printing duty is low and a photosensitive body and to prevent occurrence of noise by applying a control means to the inner wall of the aluminum tube stock of the photosensitive body. CONSTITUTION: A cleaning part 1 consists of a cleaning blade 3 which removes waste toner 12 on the photosensitive body 2, a toner receiving film 5 which prevents leak of the scraped and discharged toner, a carrier 7 which carries the discharged toner to the inner part of a case 6 and a threshold plate 8 which prevents a of the discharged toner. A photosensitive film is applied to the aluminum tube stock of the photosensitive body 2, and the control material 9 is applied to the inner wall of the aluminum tube stock. Therefore, such faults are eliminated; a slight creaking sound occurs between the photosensitive body 2 and the cleaning blade 3; moreover, the sound resonates with the photosensitive body 2 and is amplified to make noise U.S. Pat. No. 5,722,016 to Godlove et al., issued Feb. 24, 1998—An electrostatographic imaging member assembly is disclosed including an electrostatographic imaging member including a substrate, an electrostatographic imaging layer, an imaging surface on the imaging layer, a back surface on the substrate, and a preformed resilient porous gas filled acoustic dampening member at least partially compressed and in pressure contact with the back surface, the pressure contact being sufficient to substantially eliminate relative movement between the substrate and the acoustic dampening member.

U.S. Pat. No. 5,669,045 to E. Swain, issued Sep. 16, 1997—An electrostatographic imaging member assembly is disclosed which includes a hollow cylindrical electrostatographic imaging member, the member including a substrate, an exterior imaging surface, an interior back surface, a first end and a second end, a substantially rigid cylindrical core support member located within the interior of and coaxially aligned with the cylindrical electrostatographic imaging member, the cylindrical core support member extending from at least the first end to the second end of the imaging member and having an outer surface spaced from the interior back surface of the hollow cylindrical photoreceptor and at least one preformed resilient compressible sleeve under compression between the back surface of the imaging member and outer surface of the cylindrical core support, the compression being sufficient to render the electrostatographic imaging member substantially rigid and substantially free from distortion under electrostatographic image cycling conditions. A process for fabricating this imaging member is also disclosed.

U.S. Pat. No. 5,430,526 to Ohkubo et al., issued Jul. 4, 1995—An image forming apparatus is disclosed which includes a rotatable image bearing member including an image bearing layer and a base member for supporting the image bearing layer; a charging member contactable to the image bearing member for electrically charging the image bearing member; a voltage applying device for applying an oscillating voltage to the charging member; a weighting material inside the base member; and an elastic material between the base member and the weighting material. The elastic material has a hardness not more than 70 degrees (JIS-1), a thickness of 1–5 mm and an outer diameter larger by 40–400 microns than an inner diameter of the base member before it is press-fitted into the base member.

U.S. Pat. No. 4,601,963 to Takahashi et al., issued Jul. 22, 1986—A photosensitive drum is disclosed which includes a cylindrical core which may be fixedly mounted on a rotating shaft and which is comprised of an elastic material and an outer sleeve which is provided on the outer peripheral surface of the core and which includes a supporting layer and a photosensitive layer formed on the supporting layer. A combination of the elastic core and the outer sleeve is constructed such that the drum only deforms locally at a point where an external force is applied and is immediate vicinity while maintaining the other portion virtually unchanged. In one form, the outer sleeve is fixedly mounted on the core, and, in another form, the outer sleeve is detachably mounted on the core. In the latter case, it is so structured that no relative movement takes place between the core and the outer sleeve even if external forces are applied to the drum.

Japanese Patent Publication No. 63060481 Abstract to Ishii Yoshifumi, published Mar. 16, 1998—PURPOSE: To reduce a resonance sound of a photosensitive drum based on a vibration of a cleaning blade, and to reduce "squeak" by inserting by pressure a specific buffer body into the inside of a cylindrical base can body for constituting a base body of a photosensitive drum. CONSTITUTION: A photosensitive drum 2 is mainly formed by a cylindrical aluminum base can body 3, a photosensitive layer 4 which has been formed on the outside surface of this base can body, and a buffer body 5 which is inserted by pressure into its base can body, and reduces a resonance sound of the photosensitive drum 2, caused by a vibration of a cleaning blade 11. The buffer body 5 is a cylindrical sponge, and constituted so that the outside diameter D of its free state, and the length L are Larger than the inside diameter (d) of the base can body 3 of the photosensitive drum 2, and smaller than the length 1 of the same base can body 3, respectively, and inserted by pressure into about the center of the base can body 3. In this way, resonance sound of the photosensitive drum 2, based on a vibration of the cleaning blade 11 is reduced, and discomfortable "squeak" can be prevented without deteriorating the cleaning capacity of the cleaning blade 11.

Japanese Patent Publication No. 63271388 Abstract to Nakamura Kunihiko, published Nov. 9, 1998—PURPOSE: To surely remove high-frequency abnormal noises uncomfortable to the ears so that a silent operation can be made by inserting a vibration damping member such as foamed urethane into a photosensitive drum in contact with the inside wall surface of the photosensitive drum. CONSTITUTION: The vibration damping member 11 such as foamed polyurethane is provided on the photosensitive drum 1 in contact with the inside wall surface of the drum 1. The abnormal noises uncomfortable to the ears are generated when the friction force acting between the drum 1 and a cleaning blade is negative attenuation. If, however, the vibration damping member such as foamed polyurethane is inserted into the photosensitive drum in contact with the inside wall surface thereof, the member 11 oscillates with the inside wall of the drum 1 tending to oscillate and imparts positive attenuation to the drum 1 and, therefore, the oscillation beginning to be generated in the drum is sharply attenuated. The self-excited oscillation is eventually not generated and the abnormal noises are thoroughly prevented.

Japanese Patent. Publication No. 5-35167 (A) to Hiroaki Miyake, published Feb. 12, 1993 - PURPOSE: To suppress the noise to be generated by the vibration of an image hold member by inserting a rigid or elastic member into the image holding member and adhering the members by an adhesive. CONSTITUTION: A packing material 3 consisting of the rigid or elastic material is inserted into a photosensitive drum 3 which is the cylindrical image holding member. Aluminum, brass, cement, gypsum, rubber material, etc., are used as the material of the packing material 3*c*. The gap D between the photosensitive drum 3 and the packing material 3*c* is confined to max. The photosensitive drum 3 and the packing material 3*c* are adhered and fixed by the adhesive 3*d*. such as cyanoacrylate or epoxy resin. The vibration of the photosensitive drum 3 which is the major cause for electrifying sound is suppressed in this way and the generation of the electrifying sound is suppressed to a lower level even if the frequency of the AC voltage to be impressed to the electrifying roller 4 is set high.

Japanese Patent Publication No. 05281773 Abstract to Sakurai Kazue et al., published Oct. 29, 1993—PURPOSE: To prevent or reduce a generated electrification sound by inserting a gas cell structure consisting of an assembled body of the subdivided gas cells into an image carrier drum and imparting a vibration proof function in the image carrier drum. CONSTITUTION: The gas cell assembled structure 1*c* which is inserted into the image carried drum 1*c* uses a packing buffer material which is formed many independent air cells if between the materials which are formed of two soft plastic sheets 1*d,* 1*e,* and the material is wound up to make a roll and is inserted and arranged in the photosensitive drum 1. Even in the case that the image carrier drum 1 is performed an electrification treatment by an AC impression system by inserting and arranging the gas cell assembled structure 1*c* consisting of the assembly the subdivided gas cells in the image carrier drum 1 or by arranging while a gas cell assembled structure layer consisting of the assembly of subdivided gas cells is pressed by a pressure means to an inside wall surface of the image carrier drum 1 and is adhered closely with each other, the generating electrification sound (noise) be restrained to such a degree that does not practically pose any problems.

Japanese Patent Publication No. 5-35166 (A) Abstract to Masaharu Okubo, published Feb. 12, 1993—PURPOSE: To suppress the generation of noises due to vibrations at the time of electrification by holding a weight member in a cylindrical image holding member via an elastic member. CONSTITUTION: The circular cylindrical weight member 20 which is coated with the elastic member 21 on its outer periphery is press-fitted into an aluminum cylinder of a photosensitive drum 3. The weight member 20 is required to be heavier than the weight of the photosensitive drum 3 in order to exhibit a vibration-damping effect. The elastic member 21 is required to be an elastic material of 20 to 70° JIS (Japanese Industrial Standards) hardness in order to fix the weight member 20 into the photosensitive drum 3 and to transmit vibrations. More specifically, silicone rubber, urethane rubber, chloroprene rubber, NBR, SBR, EPDM, etc., are adequate. The generation of the noises due to the vibrations at the time of electrification is prevented in this way.

Japanese Patent Publication No. 63-60480 (A) Abstract to Yoshifumi Ishii, published Mar. 16, 1988—PURPOSE: To reduce "squeak" without deteriorating the cleaning capacity of a cleaning blade by absorbing a sound generated in a photosensitive drum, by forming a specific sound absorbing layer on the inside surface of a cylindrical base can body for constituting a base body of a photosensitive drum. CONSTITUTION: A photosensitive drum 2 is provided with a cylindrical base can body 3, a photosensitive layer 4 which has been formed on the outside surface of this base can body, and a sound absorbing layer 5 which can absorb a sound generated in the inside of the photosensitive drum 2 due to a vibration of a cleaning blade 11, by being formed on the inside surface of its base can body. The sound absorbing layer 5 is formed on the inside surface of the photosensitive drum 2 by a one liquid type paint whose main component is an acryl resin, and can absorb a sound generated in the inside of the photosensitive drum 2 due to a vibration of the cleaning blade 11 by unevenness of the surface of the sound absorbing layer 5, therefore, after all, a sound of the whole photosensitive drum 2 is reduced, and generation of "squeak" of the blade 11 accompanied with a discomfort sense can be prevented.

Thus, there is a continuing need for improved electrostatographic imaging members that are more reliable and simpler to fabricate.

SUMMARY OF THE INVENTION

It is, therefore, an object of the present invention to provide an improved electrostatographic imaging member silencer and method of recycling an improved electrostatographic imaging member silencer which overcomes the above-noted disadvantages.

It is another object of this invention to provide an improved electrostatographic imaging member silencer which prevents high pitched ringing, squealing, squeaking, or howling sounds during blade cleaning.

It is still another object of this invention to provide an improved electrostatographic imaging member silencer which is simple to recycle thereby eliminating waste or complex refurbishing process steps.

It is a further object of this invention to provide an improved electrostatographic imaging member silencer with improved motion quality.

The foregoing and other objects of the present invention are accomplished by providing a silencer comprising

- a hollow tube having, in the free state a predetermined inside diameter, the tube comprising
  - a tube wall having a substantially uniform thickness, an interior surface, a hard exterior surface
  - at least one groove extending axially of the tube, the groove having a depth that is less than the thickness of the tube wall and
  - a slot in the wall extending axially of the tube, and at least one partially compressed high density polymeric open cell foam plug in the interior of the hollow tube, the plug having in the uncompressed state a substantially circular cross section in at least one plane, the circular cross section of the plug having an outside diameter sufficient to increase the inside diameter of the hollow tube to a diameter at least about 5 percent greater than the predetermined inside diameter of the hollow tube in the free state. The hollow tube portion of the silencer may be recovered from a used hollow photoreceptor drum, combined with a high density polymeric open cell foam plug and installed in a fresh hollow photoreceptor drum.

BRIEF DESCRIPTION OF THE DRAWINGS

In general, the advantages of the improved drum supporting hub and drum assembly will become apparent upon consideration of the following disclosure of the invention, particularly when taken in conjunction with the accompanying drawings wherein.

These figures merely schematically illustrate the invention and are not intended to indicate relative size and dimensions of actual devices components thereof.

DETAILED DESCRIPTION OF THE DRAWINGS

The present invention may be employed in any suitable electrostatographic imaging member comprising a cylindrical drum substrate and at least one electrostatographic imaging layer that generates high pitched ringing, squealing, squeaking, or howling sounds when utilized with a cleaning device such as a cleaning blade or any other proximal device which causes vibrations, especially in the audible range, to be generated in the aforementioned electrostatographic imaging member. However, for purposes of illustration, the invention will be described with reference to an electrophotographic imaging drum.

Figure 1:
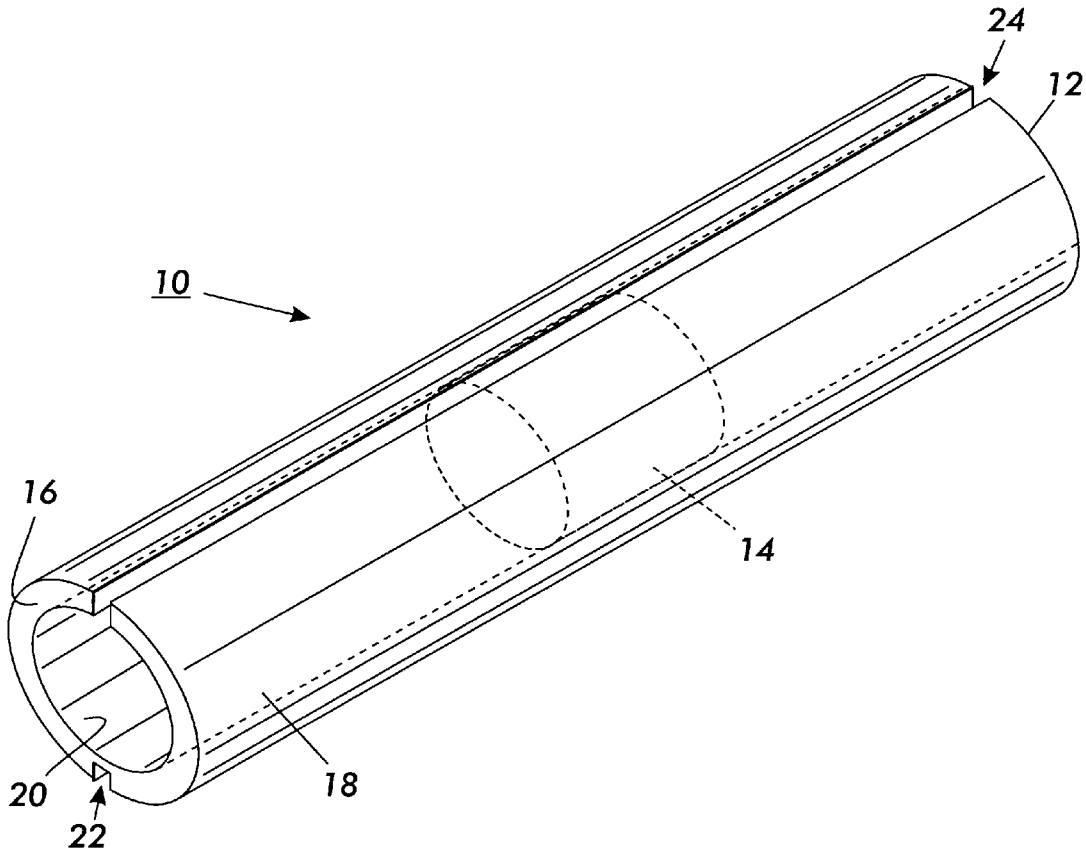
FIG. 1 illustrates an isometric view of a hollow silencer tube containing a partially compressed foam cylinder.

Referring to FIG. 1, a silencer 10 is illustrated comprising a used heavy hollow tube 12 and at least one at least one partially compressed high density polymeric open cell foam plug 14 in the interior of the hollow tube 12. Hollow tube 12 comprises a wall 16 having a substantially uniform thickness, a hard exterior surface 18 and an interior surface 20. Hollow tube 12 may comprise any suitable material such as plastic, metal, composites and the like. Hollow tube 12 also contains at least one groove 22 extending parallel to the imaginary axis of tube 12, the groove 20 having a depth that is less than the thickness of the tube wall. In addition, hollow tube 12 contains a slot 24 in wall 16 extending parallel to the imaginary axis of tube 12. Although the slot 24 is illustrated as a straight slot, any other suitable shape may be utilized such as a slot having a wavy, sawtooth or spiral pattern. However, a straight slot is preferred for simplicity of manufacture and reduced cost. Partially compressed high density polymeric open cell foam plug 14 in the uncompressed state has a substantially circular cross section in at least one plane, the circular cross section of the plug having an outside diameter sufficient to increase the inside diameter of the hollow tube 12 to a diameter at least about 5 percent greater than the predetermined inside diameter of the hollow tube in the free state (i.e. unencumbered state with no plug in the interior of tube 12). The plane of the circular cross section of the plug is ideally, but not necessarily, perpendicular to the imaginary axis of hollow tube 12 when plug 14 is installed within the interior of tube 12. Increasing the inside diameter of the hollow tube 12 to a diameter at least about 5 percent greater than the predetermined inside diameter of the hollow tube in the free state, in combination with partially compressed plug 14, ensures positive pressure contact between hard exterior surface 18 and the interior surface of a photoreceptor drum (not shown). Pressure contact between hard exterior surface 18 and the interior surface of a photoreceptor drum coupled with the mass of hollow tube 32 substantially eliminates relative movement between silencer 10 and the photoreceptor drum and ensures elimination of the high pitched ringing, squealing, squeaking, or howling sounds.

Figure 2:
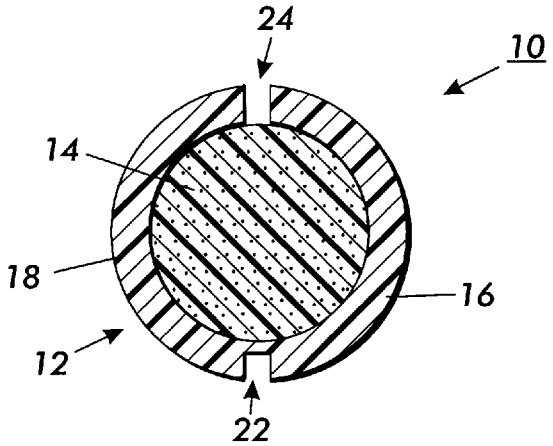
FIG. 2 illustrates a cross-sectional end view of the hollow silencer tube containing a partially compressed foam cylinder shown in FIG. 1.

In FIG. 2, a cross-sectional end view of silencer 10 comprising used hollow tube 12 hard exterior surface 18, groove 22, slot 24 and partially compressed high density polymeric open cell foam plug 14. Prior to and subsequent to insertion into the interior of hollow tube 12, plug 14 has a generally cylindrical shape. Plug 14 it may be fabricated by molding, stamping out of sheet or otherwise formed into a cylindrical shape. The outer dimensions of the expanded hollow tube 12 should be sufficiently large so that it remains compressed slightly after positioning within a photoreceptor drum (not shown) for pressure contact with the interior surface of the photoreceptor drum.

Figure 3:
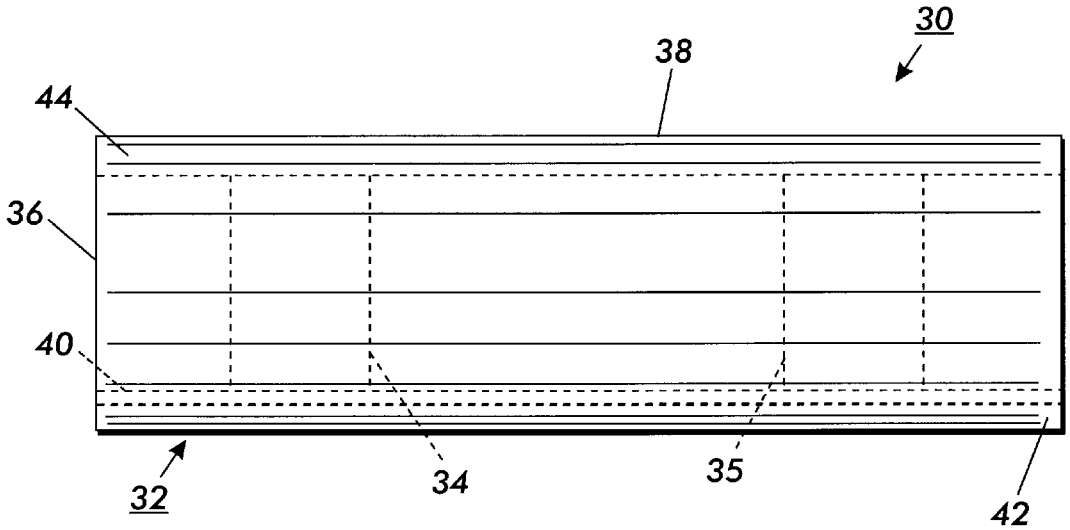
FIG. 3 illustrates a side view of a hollow silencer tube containing two spaced partially compressed foam cylinders.

Shown in FIG. 3, is a silencer 30 is illustrated comprising a used hollow tube 32 and two partially compressed high density polymeric open cell foam plugs 34 and 35 in the interior of the hollow tube 32. Hollow tube 32 comprises a wall 36 having a substantially uniform thickness, a hard exterior surface 38 and an interior surface 40. Hollow tube 32 also contains at least one groove 42 extending parallel to the imaginary axis of tube 32, the groove 42 having a depth that is less than the thickness of the tube wall 32. In addition, hollow tube 32 contains a slot 44 in wall 36 extending parallel to the imaginary axis of tube 32.

Figure 4:
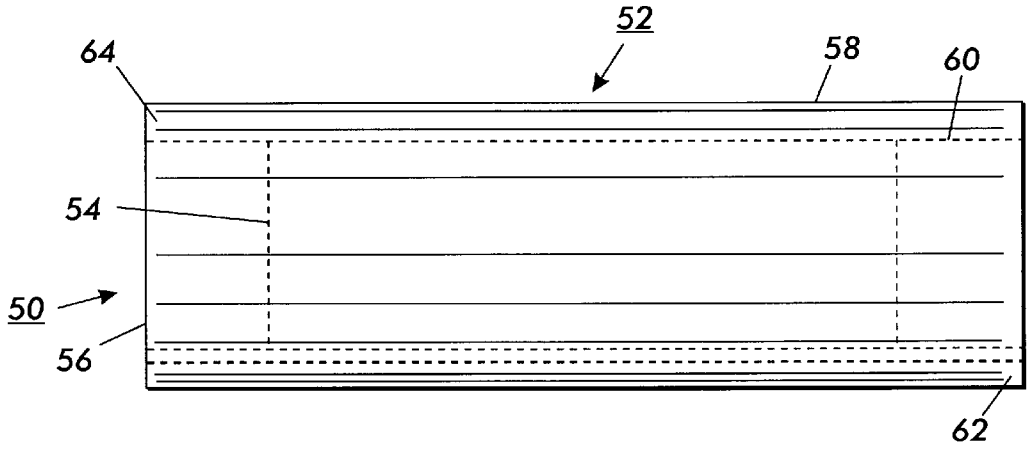
FIG. 4 illustrates a side view of a hollow silencer tube containing one long partially compressed foam cylinder.

Illustrated in FIG. 4, is a silencer 50 is illustrated comprising a used hollow tube 52 and a single long partially compressed high density polymeric open cell foam plug 54 in the interior of the hollow tube 52. Hollow tube 52 comprises a wall 56 having a substantially uniform thickness, a hard exterior surface 58 and an interior surface 60. Hollow tube 52 also contains at least one groove 62 extending parallel to the imaginary axis of tube 52, the groove 62 having a depth that is less than the thickness of the tube wall 56. In addition, hollow tube 52 contains a slot 64 in wall 56 extending parallel to the imaginary axis of tube 52.

Figure 5:
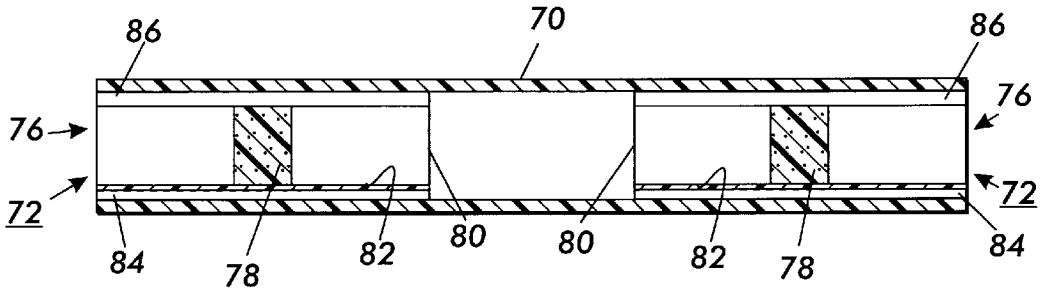
FIG. 5 illustrates a cross-sectional side view of a photoreceptor drum containing two hollow silencer tubes, each tube containing a partially compressed foam cylinder.

In FIG. 5, an electrostatographic imaging member assembly is shown in which a photoreceptor drum 70 contains two silencers 72. Each silencer 72 comprises a used hollow tube 76 and a partially compressed high density polymeric open cell foam plug 78 in the interior of the hollow tube 76. Each hollow tube 76 comprises a wall 80 having a of substantially uniform thickness, an interior surface 82. Each hollow tube 76 also contains at least one groove 84 extending parallel to the imaginary axis of tube 76, the groove 84 having a depth that is less than the thickness of the tube wall 80. In addition, hollow tube 76 contains a slot 86 in wall 80 extending parallel to the imaginary axis of tube 76.

Any suitable resilient material may be utilized for the hollow silencer tube. Typical materials include, for example, polyvinyl chloride, ABS, hard rubber, wood, polycarbonate, and the like. These materials may contain any suitable filler particle. Typical filler particles includes, for example, carbon black, talc, Teflon, clay, glass fiber, glass beads, alumina, other metal oxide powder, and the like, and mixtures thereof. The thickness of the silencer tube wall can vary depending upon a number of factors including the flexibility and density of the silencer material and the thickness and length of the photoreceptor drum substrate. Preferably, the thickness of the silencer tube wall is between about 4.5 millimeters and about 3.8 millimeters. The thickness of the silencer tube wall should be selected so that there is sufficient silencer mass to prevent undesirable noise generation when the photoreceptor drum is used in an imaging system. The silencer tube should be sufficiently rigid and sufficiently long to prevent deformation of the drum after silencer installation. Since the photoreceptor drum may be rigid or flexible, the length and rigidity of the silencer depends upon the flexibility of the photoreceptor drum employed. For flexible photoreceptor drums, the outside surface of the silencer is preferably hard to help support the imaging surface of the flexible drum during imaging. One or more silencer tubes may be used in each electrostatographic imaging tube.

Preferably, a precursor of the silencer tube having a "C" shaped cross-section is initially formed by a process, such as an extrusion process, to form a hollow tube. Any conventional and well known extrusion process may be utilized to form the tube. Machining of the extruded tube, cutting of the slit and slot (or hinging) features, and subsequent processing, such as thermal or other deforming processes to expand the diameter of the slotted and hinged tube, are performed to introduce the pressure causing force which is functionally critical to the operation of the silencer tube, and it is this spring-type force which is relied on to hold the silencer tube in pressure contact with the inside wall of the electrostatographic imaging tube and impart its vibration-damping characteristics. The outside diameter of the originally extruded silencer tube is preferably slightly smaller than the inside diameter of the photoreceptor drum in which the silencer is 21 to be employed because, after the silencer tube is installed, an almost perfectly round cross sectional shape is achieved for the silencer and surface contact between the outside of the silencer tube and the inside surface of the photoreceptor drum is maximized. Thus, a freshly extruded silencer tube can, for example, have an outside diameter of about 28.424 millimeters and this silencer after expansion and annealing would be used in a photoreceptor drum having inside diameter of about 28.5 millimeters, the inside diameter of the drum being 0.076 millimeter larger than the outside diameter of the freshly extruded silencer tube. However, if desired, the original extruded tube may have a diameter larger than the inside diameter of the photoreceptor where the silencer is compressed and annealed after the slot and hinge groove are machined.

A slot extending axially along the length of the silencer tube from one end to the other is then formed by machining to form a silencer having the "C" shaped cross-section. Surprisingly, new and used "C" shaped silencers have about the same spring constant pressure parameters. The expression "spring constant pressure" as employed herein is defined as the squeezing force, applied to opposite sides of the silencer, required to close the slot in the silencer, e.g., the force applied in a direction perpendicular to a tangent at the top and bottom of the "C" shape sufficient to close the silencer gap by a predetermined distance. Satisfactory results may be achieved with a spring constant of between about 100 grams per centimeter and about 300 grams per centimeter. Preferably, the silencers have a spring constant of between about 100 grams per centimeter and about 260 grams per centimeter. Optimum results are achieved with a spring constant pressure of about 150 grams per centimeter.

A slot width of between about 2.6 millimeters and about 3.5 millimeters is especially preferred. The walls on each side of the slot may be parallel to a radius of the silencer or at any suitable angle to a radius of the silencer so long as the silencer can be squeezed down to a diameter sufficient to allow insertion of the silencer into the interior of the photoreceptor drum. Thus, for example, the surfaces of the opposite facing sides of the slot may be parallel to each other, or the tops of the opposite facing sides of the slots may be closer together than the bottom of the opposite facing sides, or the bottoms of the opposite facing sides of the slots may be closer together than the tops of the opposite facing sides (e.g. "V" shaped slot cross section), etc. Generally, the slot width measurement is intended to refer to the straight-line distance between points on opposite sides of the slot which are the first to contact each other when the silencer is squeezed to close the slot gap. The size of the slot opening after installation in a photoreceptor drum is preferably minimized, particularly for drums with thin substrates. Generally, after installation of the silencer into the photoreceptor tube, the slot width of the silencer is smaller than the slot width prior to installation into the photoreceptor tube, but is still slightly open as opposed to tightly shut. This provides installation latitude to compensate for slight variations in inside diameter from one fresh photoreceptor tube to another.

The roundness of the cross-section of the silencer after insertion into the interior of a photoreceptor should appear to the naked eye as substantially a perfect circle. The outer surface of the silencer from one end to the other, i.e. surface in the axial direction, should be substantially straight and parallel to an imaginary axis of the silencer and photoreceptor drum to prevent distortion of the photoreceptor substrate after insertion of the silencer into the photoreceptor. The percent of the surface area of the interior wall of a photoreceptor drum contacted by the exterior surface of the silencer is preferably between about 80 percent and about 90 percent.

At least one hinge groove is also formed axially along the length of the "C" shaped tube from one end to the other. The depth and width of the groove depends upon the thickness of the silencer wall and the stiffness of the wall material and whether both the "C" shaped tube, slot and groove are all formed simultaneously during a single extrusion process or whether the slot and groove are formed by machining subsequent to extrusion of the tube. The groove functions as a hinge to reduce the amount of pressure required to partially compress and reduce the diameter of the silencer thereby facilitating insertion of the silencer into the hollow interior of a photoreceptor drum. For very stiff tube materials, mass sufficient to reduce undesirable noise may require a tube thickness that renders partial compression of the thick tube somewhat difficult during insertion into the interior of a hollow photoreceptor. The groove may be cut along the exterior surface of the silencer or along the interior surface of the silencer. However, cutting of the exterior is preferred because simpler procedures and equipment may be used. The width of the groove is preferably between about 1.7 millimeters and about 2.3 millimeters. Also, the depth of the groove should preferably be between about 4 percent and about 6 percent of the thickness of the silencer. Although more than one groove may be employed in the silencer tube, a single groove requires fewer manufacturing steps and provides adequate hinge action for facilitating compression for mounting and allowing thicker silencer tube walls which provide greater sound deadening mass. When a single groove is used, it may be positioned almost anywhere around the periphery of the silencer tube so long as it is far enough from the slot to permit compression for insertion into the interior of a hollow photoreceptor drum. Preferably, the groove is located opposite the slot, e.g., if the slot is at the 3 o'clock position, the groove is positioned at about the 9 o'clock position.

After machining of the slot and groove, the "C" shaped silencer is forced open at the slot by any suitable means to expand the diameter of the silencer and the expanded silencer is thereafter annealed while maintained in the expanded state. Expanding may be effected by any suitable method such as by inserting one or more wedges into the slot or inserting fingers into each end of the silencer followed by spreading apart of the fingers. After expansion of the silencer, the silencer is heated above the glass transition temperature of the silencer material followed by cooling below the glass transition temperature while the silencer remains in the expanded configuration . This cooling can be accomplished by any suitable technique. Typical accelerated cooling techniques include, for example, using cold or cool water or other cool or cold liquids or gas as a spray or a bath to reduce the time required to bring the silencer below its glass transition temperature. The annealing process freezes the expanded silencer so that it retains the larger diameter even after the device used to enlarge the diameter of the silencer is removed. Upon cooling, the silencer may be removed from expanding devices such as the wedges or expanding fingers. During use of the expanded silencer in a photoreceptor drum, the silencer at least partially returns to the shape it had prior to expansion and annealing. This return or partial return to the shape it had prior to expansion and annealing can render the silencer unsuitable for reuse in a fresh photoreceptor drum, particularly if the inside diameter of the fresh drum is slightly larger than the inside diameter of the previous drum from which the silencer was removed.

After a silencer has been utilized in a photoreceptor for about an average period of six months to form about 18,000 to 40,000 copies, it is noted that the silencer does not spring back to its original shape after removal from the interior of a hollow drum photoreceptor. Upon removal of the silencer from a used photoreceptor drum for recycling and installation into a fresh drum, the silencer loses its effectiveness for dampening sounds due to insufficient pressure contact between the silencer and the interior of the drum. Both the outside diameter and inside diameter of the "C" shaped silencer have become smaller with use in the previous drum due to plastic deformation under the influence of compression for an extended period of time. After a silencer has undergone elastic deformation while cycled in a drum, removal of the silencer from the drum leads to partial recovery of the silencer in about 3 days at ambient temperature toward the original annealed size due to creep or cold flow. The expressions "creep" and "cold flow" are defined as the gradual change of shape of the silencer towards the original annealed shape due to memory effects. However, the recovery is only partial and the silencer does not return to the original annealed (expanded) size. New drum substrates can vary considerably in inside diameter from one drum to another. Typically, such variation can vary between about 28.475 millimeters and about 28.525 millimeters. Thus, a used silencer can be in effective in some new drums but be ineffective in other new drums. In other words, a recycled silencer can lose its effectiveness for dampening sounds in some drums due to insufficient pressure contact between the silencer and the interior of the drum.

The number of recycled silencers utilized within the interior of a photoreceptor drum depends on various factors such as, for example, the length of the photoreceptor drum, the length of the silencer, the flexibility, density and mass of materials utilized in the drum substrate and the silencer, and the pressure originally exerted by each silencer against the interior surface of the drum. Generally, at least about 90 percent of the outside surface of each silencer should be in intimate pressure contact with interior surface of the drum photoreceptor in order to effectively dampen vibrations. Also, between about 80 percent and about 90 percent of the total interior surface of the drum photoreceptor should be in pressure contact with the outside surface of the silencer or silencers. If less than about 80 percent of the total interior surface of the drum photoreceptor is contacted by the silencer or silencers, the likelihood of undesirable noise generation is high. The threshold of noise generation can vary depending upon various other factors such as thickness and length of the photoreceptor drum's substrate, type of any cleaning blade contacting the drums surface, speed of rotation of the drum, diameter of the drum, and the like. Typically, between about 1 and about 3 silencers are utilized within the interior of a drum photoreceptor. The higher number being utilized for longer length photoreceptor drums such as photoreceptors having a length between about 250 millimeters and about 340 millimeters. When a single silencer is utilized, it is preferably placed in about the middle of the photoreceptor drum. When two or more silencers are employed, they are preferably uniformly spaced along the length of the photoreceptor. Some adjustment of the locations of multiple silencers may be desirable to optimize sound elimination. For long photoreceptors, a plurality of silencers may be utilized or they may be replaced by a single long silencer. Shorter multiple silencers are preferred because they are more easily inserted and removed from the interior of the photoreceptor drum. Generally, the silencers should apply a force against the interior surface of the photoreceptor drum of between about 550 grams and about 1200 grams to minimize squealing, squeaking and humming. The percent of the length of the hollow electrostatographic drum in contact with the recycled silencer tube depends on factors such as the mass of acoustic dampening material utilized, the circumferential arc contacted and the thickness of the drum. Although an electrophotographic imaging drum may vibrate at three or four frequencies, the undesirable squealing or howling sound is believed to be due to a fundamental frequency having a node at the center of the drum. Thus, the recycled silencer tube is preferably in contact with a region of the hollow interior surface of the drum located from each end of the imaging member at a distance of up to about one third of the length of drum. The acoustic dampening member need not be in continuous contact with the entire circumferential band within that region. Contact between the silencer and the drum should be lengthened for thin drums, particularly long thin drums to minimize undesirable distortion of the drum during an imaging cycle. The exterior contacting surface of a used silencer tube does not include the open space in the groove or in the slot.

Instead of substantially continuous contact, a plurality of segments of the interior surface of the drum may be contacted by the exterior contacting surface of the recycled silencer tube. When only a narrow single groove is formed in the exterior surface of the used silencer tube and if the slot of the tube is almost closed after mounting of the tube is completed within the interior of a fresh drum, the tube will contact almost all of the adjacent interior surface of the drum. Generally, satisfactory results may be achieved when the sum of segmental contacts by the recycled silencer tube along a circumferential band extending around the interior of the drum equals at least about 80 percent of the circumference. Preferably the recycled silencer tube is in contact with at least about 90 percent of the interior circumference of the hollow interior surface of an electrostatographic imaging drum. Optimum results are achieved when contact includes at least about 95 percent of the interior circumference. Since the area of each zone of segmental contact circumferentially or axially along a drum interior surface can be large or small and since the degree of sound elimination can vary with the specific characteristics of the recycled silencer tube, substrate and blade materials employed, some experimentation is desirable with specific combinations of materials utilized to determine the minimum amount contact sufficient to eliminate the undesirable squealing or howling sound created during contact between the imaging drum and cleaning blade.

Any suitable flexible compressible high density plastic open cell foam plug may be used in the silencer of this invention. The expression "open cell" as employed herein is defined as cells open to adjacent cells to allow gas from one cell to flow into adjacent cells when the foam is compressed. The cells are gas filled and may have any suitable shape such as spherical, oval, angular or the like. Also, the cavities may be of the same or different sizes. The average size of the cells vary depending upon the hardness, density, dimensions and other characteristics of the foam plug, the number of plugs used in the silencer, the spring constant of the silencer, and the like. Any suitable gas in the cells may be utilized. Typical gases include, for example, air, nitrogen, carbon dioxide, argon and the like. The foam plug should be sufficiently resilient to spring back to its original shape and size after compressive forces are applied and thereafter removed. Compressibility, including the property of returning to its original shape, is important in order to cause the partially compressed compressible high density plastic open cell foam plug to supply sufficient pressure against the inner surface of the used silencer tube to expand the tube to between about 99 and about 100 percent of the original free state diameter when it was originally annealed. This will ensure uniform and supportive contact between the hard outer surface of the recycled silencer tube and the interior surface of the hollow photoreceptor drum.

The plug preferably has a Shore zero hardness value of between about 12 and its about 17 and exhibits a compression set of at least about 10 percent by weight under ASTM D3574 at 70° C. Preferably, the plug has a high density of between about 15 pounds per cubic foot (216 kilograms per cubic meter) and about 16.5 pounds per cubic foot (256 kilograms per cubic meter) and compression force deflection between 4 psi (27 Kpa) and about 8 psi (55 Kpa). However, the desired effects may be achieved with a plug having a lower compression force deflection of between about 1 psi (7 Kpa) and about 5 at psi (35 Kpa) if there are more plugs in the interior of the silencer. The density, hardness and number of plugs should be sufficient to re-expand the inside and outside diameters of the silencer to between about 99 percent and about 100 percent of the inside and outside diameters of the original annealed silencer prior to first use inside of a photoreceptor drum. Since the original annealed silencer does not form a perfect circle, the expression "outside diameter" as employed herein for silencers is the largest diameter value measured across the cross section of the non-round object (outside surface to opposite outside surface).

Any suitable resilient and foamable film forming polymer material may be utilized in the flexible open cell foam plug. Typical polymers include, for example, polyurethane, natural rubber, poly(vinyl chloride), nitrile rubber, polysiloxane, and the like. A preferred polymeric foam plug comprises flexible polyurethane open cell foam. These urethane open cell foam materials are commercially available, for example, Poron, available from Rogers Corporation. Although materials such as solid rubber are compressible and return to their original shape, a solid rubber plug is difficult to install and difficult to remove.

Generally, the outside diameter of the plugged silencer (plug and silencer assembly) in the free uncompressed state has an interference of at least about 0.1 millimeter relative to the inside diameter of the photoreceptor drum. In other words, the outside diameter of the uncompressed plugged silencer is preferably at least about 0.1 millimeter greater than the inside diameter of the photoreceptor drum. The maximum interference depends upon the number of plugs in a silencer and the characteristics of the foam plug such as length, density, hardness, and the like and the amount of silencer expansion desired. The foam plug may have any suitable axial length. A typical axial length is about 0.5 inch (1.3 centimeters). A plug having a cylindrical shape is preferred because it is readily formed by cutting out the plug from sheet high density foam material, formed by molding, and the like. However, it may have any other suitable shape where the plug, in the uncompressed state, has a substantially circular cross section in at least one plane such as football, sphere and the like may be utilized so long as the silencer is re-expanded by the plug to between about 99 percent and about 100 percent of the original outside diameter of the silencer tube after annealing, but before first use. In other words a used annealed hollow silencer tube has an interior surface and, in the free state, a predetermined inside diameter which is expanded to about the original annealed inside diameter (condition following annealing and prior to first use) by one or more compressed high density polymer open cell plugs for recycling. The substantially circular cross-section of the plug preferably has an imaginary axis coaxial with the imaginary axis of the silencer. Moreover, the plane of the circular cross section is preferably perpendicular to the imaginary axis of the silencer. The preformed plug may be inserted into the interior of the used silencer tube by any suitable technique such as by hand, by a push rod, by a robot, and the like. The hard outer surface of the silencer tube is in pressure contact with the inner surface of the photoreceptor drum and, for thin drums, provides longitudinal and cylindrical support to maintain the shape of the photoreceptor during the imaging cycle. Surprisingly, the combination of the used tube and plug in the silencer may be used and reused for a total of about four times with effective silencing of a drum during image cycling. After reuse for about four times with the installed plug, the plugs may be replaced with fresh plugs and the resulting silencer may recycled further so long as the outer surface of the reused silencer tube is still usable for further use as a silencer.

Any suitable technique may be utilized that can compress and insert the silencers within the interior of the drum photoreceptor. One technique is to employ a funnel comprising a generally cone shaped entrance region in which the inside diameter of the largest part of the cone is larger than the outside diameter of the uncompressed silencer. The inside diameter of the opening at the exit of the funnel should be equal to or less than the inside diameter of the drum photoreceptor. Upon insertion into the drum, the reused silencer tube containing at least one plug has sufficient restorative forces to spring open and apply adequate pressure against the interior surface of the hollow photoreceptor drum.

Any suitable technique may be utilized to remove the silencer from the interior of a photoreceptor drum for recycling in a fresh photoreceptor drum. The photoreceptor may merely be cut away from the silencer such as, for example, by slicing the photoreceptor and peeling away the drum from the silencer.

The hollow electrostatographic imaging drum may comprise an electrophotographic imaging drum or an electrographic imaging drum. Electrophotographic imaging drums and is electrographic imaging drums are well known in the art. Electrostatographic imaging drums usually comprise a supporting hollow drum substrate having an electrically conductive surface. Electrophotographic imaging members also comprise at least one photoconductive layer. A blocking layer may optionally be positioned between the substrate and the photoconductive layer. If desired, an adhesive layer may optionally be utilized between the blocking layer and the photoconductive layer. For multilayered photoreceptors, a charge generation layer is usually applied onto the blocking layer and a charge transport layer is subsequently formed over the charge generation layer. For electrographic imaging drums, an electrically insulating dielectric layer is applied directly onto the electrically conductive surface.

The supporting substrate may be opaque or substantially transparent and may comprise numerous materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like. The electrically insulating or conductive substrate is can be rigid or flexible (e.g. thin aluminum or electroformed nickel) and in the form of a hollow cylinder. Thus, the photoreceptor drum substrates may be of any suitable material. Typical drum substrate materials include, for example, metals such as aluminum and nickel; plastic materials such as polystyrene and polycarbonate; composites and the like.

The thickness of the supporting substrate layer depends on numerous factors, including beam strength, mechanical toughness, and economical considerations. Typical substrate layer thicknesses used for a hollow cylinder application may range from about 25 micrometers to about 1,500 micrometers. A typical hollow photoreceptor drum has an outside diameter of about 30 millimeters and an inside diameter of about 28.5 millimeters. However, if desired, other hollow drums with different outside and inside diameters may be employed.

The conductive layer may vary in thickness over substantially wide ranges. If the substrate is electrically conductive, a separate conductive layer may be unnecessary. For example if the substrate is a metal such as an electroformed nickel or thin walled aluminum tube, a separate conductive layer may be omitted.

An optional hole blocking layer may be applied to the substrate or conductive layer for photoreceptors. The hole blocking layer should be continuous and have a dry thickness of less than about 0.2 micrometer. An optional adhesive layer may be applied to the blocking layer. Any suitable adhesive layer well known in the art may be utilized Satisfactory results may be achieved with the adhesive layer thickness between about 0.05 micrometer and about 0.3 micrometer.

Any suitable charge generating (photogenerating) layer may be applied onto the adhesive layer, blocking layer or conductive layer. Charge generating layers are well know in the art and can comprise homogeneous layers or photoconductive particles dispersed in a film forming binder. Examples of charge generating layers are described, for example, in U.S. Pat. No. 3,357,989, U.S. Pat. No. 3,442,781, and U.S. Pat. No. 4,415,639, the disclosures thereof being incorporated herein in their entirety. Other suitable photogenerating materials known in the art may also be utilized, if desired.

Any suitable polymeric film forming binder material may be employed as the matrix in of the photogenerating layer. Typical polymeric film forming materials include those described, for example, in U.S. Pat. No. 3,121,006, the disclosure thereof being incorporated herein in its entirety. The photogenerating composition or pigment may be present in the film forming binder composition in various amounts. Generally, from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition.

The photogenerating layer generally ranges in thickness from about 0.1 micrometer to about 5 micrometers, preferably from about 0.3 micrometer to about 3 micrometers. The photogenerating layer thickness is related to binder content. Higher binder content compositions generally require thicker layers for photogeneration.

The charge transport layer may comprise any suitable transparent organic polymer or non-polymeric material capable of supporting the injection of photogenerated holes or electrons from the charge generating layer and allowing the transport of these holes or electrons through the organic layer to selectively discharge the surface charge. The charge transport layer not only serves to transport holes or electrons, but also protects the is photoconductive layer from abrasion or chemical attack. The charge transport layer should exhibit negligible, if any, discharge when exposed to a wavelength of light useful in electrophotography. The charge transport layer in conjunction with the charge generating layer is an insulator to the extent that an electrostatic charge placed on the charge transport layer is not conducted in the absence of illumination. Charge transport layer materials are well known in the art.

The charge transport layer may comprise activating compounds or charge transport molecules dispersed in normally, electrically inactive film forming polymeric materials. These charge transport molecules may be added to polymeric film forming materials. An especially preferred charge transport layer employed in multilayer photoconductors comprises from about 25 percent to about 75 percent by weight of at least one charge transporting aromatic amine, and about 75 percent to about 25 percent by weight of a polymeric film forming resin in which the aromatic amine is soluble. Examples of typical charge transporting aromatic amines include triphenylmethane, bis(4-diethylamine-2-methylphenyl)phenylmethane; 4'-4"-bis(diethylamino)-2', 2"-dimethyltriphenylmethane; N,N'-bis(alkylphenyl)-(1,1'-biphenyl)-4,4'-diamine wherein the alkyl is, for example, methyl, ethyl, propyl, n-butyl, etc.; N,N'-diphenyl-N,N'-bis(3"-methylphenyl)-(1,1'biphenyl)4,4'diamine; and the like, dispersed in an inactive resin binder.

Any suitable inactive resin binder may be employed. Typical resin binders include polycarbonate resins, polyvinylcarbazole, polyester, polyarylate, polyacrylate, polyether, polysulfone, and the like. Molecular weights can vary from about 20,000 to about 150,000.

The thickness of the charge transport layer may range from about 10 micrometers to about 50 micrometers, and preferably from about 20 micrometers to about 35 micrometers. Optimum thicknesses may range from about 23 micrometers to about 31 micrometers.

An optional conventional overcoating layer may also be used. The optional overcoating layer may comprise organic polymers or inorganic polymers that are electrically insulating or slightly semi-conductive. The overcoating layer may range in thickness from about 2 micrometers to about 8 micrometers, and preferably from about 3 micrometers to about 6 micrometers.

For electrographic imaging members, a dielectric layer overlying the conductive layer may be substituted for the photoconductive layers. Any suitable, conventional, electrically insulating dielectric polymer may be used in the dielectric layer of the electrographic imaging member.

This invention will further be illustrated in the following, non-limiting examples, it being understood that these examples are intended to be illustrative only and that the invention is not intended to be limited to the materials, conditions, process parameters and the like recited therein.

COMPARATIVE EXAMPLE I

A photoconductive imaging member was provided comprising a hollow cylindrical photoreceptor having a length of 253 millimeters, an outside diameter of 30.00 millimeters and an inside diameter of 28.5 millimeters. This photoreceptor comprised an aluminum substrate having thickness of 1 millimeter, a thin polysiloxane charge blocking layer, a charge generating layer having a thickness of 0.8 micrometer and comprising photoconductive pigment particles dispersed in a film forming binder, and a charge transport layer having a thickness of 20 micrometers and comprising an arylamine dissolved in a polycarbonate binder. The imaging member was rotated around its axis at 80 rpm and brought into contact with a resilient polyurethane elastomer cleaning blade. The cleaning blade was maintained in a doctoring or chiseling attitude during contact with the outer imaging surface of the rotating photoconductive imaging member. Contact between the cleaning blade and the moving imaging surface caused the production of a loud ringing or squeaking sound.

COMPARATIVE EXAMPLE II

The procedures described in Example I was repeated with the identical materials except that the hollow cylindrical photoreceptor was fitted with a pair of recycled silencer tubes, each comprising a tube made of filled polyvinyl chloride having a length of 100 millimeters, a wall thickness of about 4 millimeters, a groove width of 3.5 millimeters, a hinge thickness of between about 0.6 millimeter and about 0.7 millimeter, a slot width of about 3.5 millimeters and an outside diameter of 28.5 millimeters in the free (relaxed) state. These recycled silencer tubes did not contain any plugs. The pair of recycled silencer tubes were evenly spaced between the ends of the hollow cylindrical photoreceptor. After installation in the photoreceptor the recycled silencer tubes slipped inside the photoreceptor when the photoreceptor was rotated. An audible squeaking or ringing sound was also produced when the moving imaging surface was contacted with a cleaning blade.

EXAMPLE III

The procedures described in Example II was repeated with the identical materials and identical recycled silencer tubes except that a plug was inserted into the interior of each of the recycled silencer tubes prior to installation of the silencer tubes into the hollow cylindrical photoreceptor. In the free (relaxed) state (i.e. prior to installation) the plug had a cylindrical shape with a length of 12.7 millimeters and a diameter of 21.8 millimeters. The plug was a compressible high density polymeric open cell polyurethane foam (Poron, available from Rogers Corporation) having a density of 15 lbs/ft$^3$ and a Shore "O" hardness value of hardness of 12 Durometer. After hand installation of a plug in the center of each tube, each plug increased the diameter of each used tube from the original free state diameter of 28.5 millimeters to a new free state diameter of 28.8 millimeters. The recycled silencer tubes were then installed into the drum with the aid of a funnel to compress the tubes to a diameter less than the inside diameter of the drum. The tubes were evenly spaced along the length of the drum. When the photoreceptor was rotated with the installed recycled silencer tube and plug, the recycled silencer tube did not slip inside the photoreceptor and no audible squeaking or ringing sound was heard when the moving imaging surface was contacted with a cleaning blade.

COMPARATIVE EXAMPLE IV

A photoconductive imaging member was provided comprising a hollow cylindrical photoreceptor having a length of 340 millimeters, an outside diameter of 30 millimeters and an inside diameter of 28.5 millimeters. This photoreceptor comprised an aluminum substrate having thickness of 1 millimeter, a thin polysiloxane charge blocking layer, a charge generating layer having a thickness of 0.8 micrometer and comprising photoconductive pigment particles dispersed in a film forming binder, and a charge transport layer having a thickness of 20 micrometers and comprising an arylamine dissolved in a polycarbonate binder. The imaging member was rotated around its axis at 87 rpm and brought into contact with a resilient polyurethane elastomer cleaning blade. The cleaning blade was maintained in a doctoring or chiseling attitude during contact with the outer imaging surface of the rotating photoconductive imaging member. Contact between the cleaning blade and the moving imaging surface caused the production of a loud ringing or squeaking sound.

EXAMPLE V

The procedures described in Example IV was repeated with the identical materials except that the hollow cylindrical photoreceptor was fitted with a three recycled silencer tubes, each comprising a polyvinyl chloride tube having a length of 100 millimeters, a wall thickness of about 4 millimeters, a groove width of 2.0 millimeters, a hinge thickness of between about 0.6 millimeter and about 0.7 millimeter, a slot width of about 3.5 millimeters and an outside diameter of 28.5 millimeters in the free (relaxed) state. The recycled silencer tubes were evenly spaced between the ends of the tube. The recycled silencer tubes did not contain any plugs. The after installation in the photoreceptor the recycled silencer tubes slipped inside the photoreceptor when the photoreceptor was rotated. An audible squeaking or ringing sound was also produced when the moving imaging surface was contacted with a cleaning blade.

EXAMPLE VI

The procedures described in Example V was repeated with the identical materials and identical recycled silencer tubes except that a plug was inserted into the interior of each of the recycled silencer tubes prior to installation of the silencer tubes into the hollow cylindrical photoreceptor. In the free (relaxed) state (i.e. prior to installation) the plug had a cylindrical shape with a length of 12.7 millimeters and a diameter of 21.8 millimeters. The plug was a compressible high density polymeric open cell polyurethane foam (Poron, available from Rogers Corporation) having a density of 15 $lb/ft^3$ and a Shore "O" hardness value of hardness of 12 Durometer. After hand installation of a plug in the center of each tube, each plug increased the diameter of each used tube from the original free state diameter of 28.5 millimeters to a new free state diameter of 28.8 millimeters. The recycled silencer tubes were then installed into the drum with the aid of a funnel to compress the tubes to a diameter less than the inside diameter of the drum. The tubes were evenly spaced along the length of the drum. When the photoreceptor was rotated with the installed recycled silencer tube and plug, the recycled silencer tube did not slip inside the photoreceptor and no audible squeaking or ringing sound was heard when the moving imaging surface was contacted with a cleaning blade.

COMPARATIVE EXAMPLE VII

The procedures and materials described in Example II were repeated except that in addition to the cleaning blade in contact with the moving imaging surface, the outer surface of a conventional bias charging roll (BCR) was contacted with the imaging surface. The bias charging roll was powered by an AC power supply to apply a 500 volt negative charge to the imaging surface. Contact between both the cleaning blade and the BCR with the moving imaging surface caused the production of an audible loud ringing or squeaking sound much greater than 55 dB.

EXAMPLE VIII

The procedures described in Example VII were repeated with the identical materials except that a plug was inserted into the interior of each of the recycled silencer tubes prior to installation of the silencer tubes into the hollow cylindrical photoreceptor. In the free (relaxed) state (i.e. prior to installation) the plug had a cylindrical shape with a length of 12.7 millimeters and a diameter of 21.8 millimeters. The plug was a compressible high density polymeric open cell polyurethane foam (Poron, available from Rogers Corporation) having a density of 15 $lb/ft^3$ and a Shore "O" hardness value of hardness of 12 Durometer. After hand installation of a plug in the center of each tube, each plug increased the diameter of each used tube from the original free state diameter of 28.5 millimeters to a new free state diameter of 28.8 millimeters. The recycled silencer tubes were then installed into the drum with the aid of a funnel to compress the tubes to a diameter less than the inside diameter of the drum. The tubes were evenly spaced along the length of o the drum. When the photoreceptor was rotated with the installed recycled silencer tube and plug, the recycled silencer tube did not slip inside the photoreceptor and no audible sound >55 dB was heard when the moving imaging surface was contacted by the BCR.

The invention has been described in detail with particular reference to preferred embodiments thereof but it will be understood that variations and modifications can be effected within the spirit and scope of the invention as described herein above and as defined in the appended claims.

What is claimed is:

1. A silencer comprising a hollow tube having an interior surface, the hollow tube in a free state having a predetermined inside diameter, the hollow tube also comprising a tube wall having a substantially uniform thickness, at least one groove extending axially of the hollow tube, the at least one groove having a depth that is less than the thickness of the tube wall and a slot in the tube wall extending axially of the hollow tube, and at least one partially compressed preformed high density polymeric open cell foam plug in the interior of the hollow tube, the at least one preformed high density polymeric open cell foam plug having in an uncompressed state a substantially circular cross section in at least one plane, the substantially circular cross section of the at least one preformed high density polymeric open cell foam plug having an outside diameter sufficient to increase the inside diameter of the hollow tube to a diameter at least about 5 percent greater than the predetermined inside diameter of the hollow tube in the free state.

2. A silencer according to claim 1 wherein the outside diameter of the at least one preformed high density polymeric open cell foam plug in the uncompressed state is at least about 0.1 millimeter greater than the predetermined inside diameter of the hollow tube in the free state.

3. A silencer according to claim 1 wherein the slot has a slot width of between about 2.6 millimeters and about 3.5 millimeters.

4. A silencer according to claim 1 wherein the at least one groove has a width of between about 1.7 millimeters and about 2.3 millimeters.

5. A silencer according to claim 1 wherein the at least one groove has a depth of between about 4 percent and about 6 percent of the thickness of the hollow tube.

6. A silencer according to claim 1 wherein the hollow tube is a recycled tube.

7. A silencer according to claim 6 wherein the hollow tube is an annealed tube having an original annealed inside diameter reduced to the predetermined inside diameter by plastic deformation during previous use in a hollow photoreceptor drum.

8. A silencer according to claim 7 wherein the at least one partially compressed preformed high density polymeric open cell foam plug in the interior of the hollow tube expands the hollow tube to between about 99 percent and about 100 percent of the original annealed inside diameter.

9. A silencer according to claim 1 wherein the interior surface of the hollow tube is in pressure contact with at least two partially compressed preformed high density polymeric open cell foam plugs.

10. A silencer according to claim 1 wherein the interior surface of the hollow tube is in pressure contact with at least three partially compressed preformed high density polymeric open cell foam plugs.

11. A silencer according to claim 1 wherein the at least one partially compressed preformed high density polymeric open cell foam plug applies a force against the interior surface of the hollow tube of between about 550 grams and about 1200 grams.

12. A silencer according to claim 1 wherein the at least one partially compressed preformed high density polymeric open cell foam plug has a Shore zero hardness value of between about 12 and about 17.

13. A silencer according to claim 1 wherein the at least one partially compressed preformed high density polymeric open cell foam plug has a density of between about 216 kilograms per cubic meter and about 256 kilograms per cubic meter.

14. A process comprising providing a used hollow photoreceptor drum having an interior surface and at least one silencer mounted within the used hollow photoreceptor drum, the at least one silencer comprising a hollow tube having an interior surface and an outer surface, the hollow tube having in a free state a predetermined inside diameter, the hollow tube also comprising a tube wall having a substantially uniform thickness, at least one groove extending axially of the hollow tube, the at least one groove having a depth that is less than the thickness of the tube wall and a slot in the tube wall extending axially of the hollow tube removing the at least one silencer from the used hollow photoreceptor drum, providing in an uncompressed state at least one preformed high density polymeric open cell foam plug, inserting the at least one preformed high density polymeric open cell foam plug into the interior of the hollow tube to form at least one partially compressed preformed high density polymeric open cell foam plug, the at least one preformed high density polymeric open cell foam plug having in the uncompressed state a substantially circular cross section in at least one plane, the substantially circular cross section of the at least one preformed high density polymeric open cell foam plug having in the uncompressed state an outside diameter sufficient to increase the inside diameter of the hollow tube to a diameter at least about 5 percent greater than the predetermined inside diameter of the hollow tube in the free state, providing a fresh hollow photoreceptor drum having an interior surface, and inserting the at least one silencer with the at least one preformed high density polymeric open cell foam plug into the hollow fresh photoreceptor drum.

15. A process according to claim 14 wherein the at least one silencer has a spring constant value against the interior surface of the fresh hollow photoreceptor drum of between about 100 grams per centimeter and about 300 grams per centimeter.

16. A process according to claim 14 wherein the fresh hollow photoreceptor drum has an inside diameter and prior to inserting the at least one silencer with the at least one preformed high density polymeric open cell foam plug into the fresh hollow photoreceptor drum, the at least one silencer in a free uncompressed state has an outside diameter which has an interference of at least about 0.1 millimeter greater than the inside diameter of the fresh hollow photoreceptor drum.

17. A process according to claim 14 wherein the at least one preformed high density polymeric open cell foam plug has a substantially cylindrical shape.

18. A process according to claim 14 wherein the at least one preformed high density polymeric open cell foam plug comprises open cell polyurethane foam.

19. A process according to claim 14 wherein the interior surface of the hollow tube is in pressure contact with at least two partially compressed preformed high density polymeric open cell foam plugs.

20. A process according to claim 14 wherein between about 7 percent and about 8 percent of the interior surface of the hollow tube is in pressure contact with at least one partially compressed preformed high density polymeric open cell foam plug.

21. A process according to claim 14 wherein between about 80 percent and about 90 percent of the interior surface of the fresh hollow photoreceptor drum is in pressure contact with the outer surface of the hollow tube of the at least one silencer.

* * * * *